United States Patent [19]

Drake

[11] 3,957,027

[45] May 18, 1976

[54] TAKE-DOWN AND FOLDING BOW

[75] Inventor: Harry E. Drake, Morgan, Utah

[73] Assignee: Browning Mfg. Company, Morgan, Utah

[22] Filed: Jan. 8, 1975

[21] Appl. No.: 539,297

[52] U.S. Cl. ..... 124/23 R; 124/30 R
[51] Int. Cl.[2] ..... F41B 5/00
[58] Field of Search ..... 124/24 R, 23 R, 30 R, 124/22, 17

[56] References Cited

UNITED STATES PATENTS

| | | | |
|---|---|---|---|
| 2,426,283 | 8/1947 | Pearson | 124/23 R |
| 2,457,793 | 12/1948 | Bear | 124/23 R |
| 3,207,146 | 9/1965 | Grable | 124/24 R |
| 3,262,442 | 7/1966 | Grable | 124/24 R |
| 3,486,495 | 12/1969 | Allen | 124/24 R |
| 3,635,205 | 1/1972 | Wood | 124/24 R |
| 3,841,295 | 10/1974 | Hunter | 124/24 R |
| 3,854,467 | 12/1974 | Hofmeister | 124/24 R |

*Primary Examiner*—Richard C. Pinkham
*Assistant Examiner*—William R. Browne
*Attorney, Agent, or Firm*—Trask & Britt

[57] ABSTRACT

An archery bow includes a handle and two limbs, each of which is attached to the handle through a connector which permits the limbs to be either detached or folded with respect to the handle. The "tiller" of the bow may be adjusted through the connectors or by interchanging limbs. The draw weight of the bow may also be adjusted through the connectors without changing or otherwise modifying the limbs. Both tiller and draw weight are adjusted by altering the attitude of the limbs with respect to the handle through the connectors.

9 Claims, 6 Drawing Figures

TAKE-DOWN AND FOLDING BOW

BACKGROUND OF THE INVENTION

Field

This invention relates to archery bows and is specifically directed to improved folding and take-down bows.

State of the Art

As the sport of archery has become increasingly popular over the years, archery bows have been improved in many ways. Modern materials of construction have become predominant, and various accessory items such as bow sights, bow-mounted quivers and the like, are commonplace. A class of bows which has become increasingly popular, particularly with hunters, is that in which the bow may be either folded or disassembled for transport and storage. An ancient example of such a bow is that described by U.S. Pat. No. 217,741 to E. S. Morton (1879). More recent examples may be found in the disclosures of U.S. Pat. Nos. 2,001,470; 2,457,793; 2,514,638; and 3,612,028. Various take-down hunting bows of the type wherein the limbs are detachable from the handles are well known. Several such bows are described, for example, in the July, 1972 issue (page 10–14) of *Archery World*, a journal devoted to the sport of archery, in an article concerning two recognized classes of such bows. The first, or "take-apart," type involves the use of tools to attach or remove limbs from a bow handle. The second, or "take-down," type is similar in features, but requires no external tool for assembly or disassembly of the limbs.

The magnitude of the force required for an archer to hold a bow at full drawn length, normally 28 inches, is known as the bow's "draw weight." The draw weight is a function of limb stiffness and the angle (or attitude) at which the limb extends from the handle. Limb stiffness is determined by limp shape, materials of construction, and cross sectional geometry. All of these factors are inherently present in the limb as it comes from the factory.

As is well known, the upper and lower limbs of a conventional bow are rarely identical. The lack of symmetry of conventional bows is known in the art as "tiller." Tiller is necessary because a bow is normally grasped such that the force applied to the limbs is not truly normal to the bow handle. Ordinarily, the draw force has a vertical, downward component, thereby necessitating a modification of the lower limb so that it will defect more (be weaker than) the upper limb.

Notwithstanding the many improvements pertaining to bow construction, certain inconveniences and limitations persist. One of the principal advantages of the take-down bow is the ability to interchange limbs to accommodate to different draw weights or tiller requirements of an archer. This approach permits selection only from among limbs differing incrementally in stiffness. Proper tillering is particularly difficult to achieve by simply interchanging limbs, because it is somewhat dependant upon differences in the anatomies of individual archers. Greater variability then is provided by factory limbs is required for precise tillering. Moreover, merely interchanging limbs, although an improvement, will not serve to completely adjust to individual specifications, a bow which is intermittently shot by more than one archer. There remains a need in the art for a bow which provides continuous adjustment of individual limbs over a range of draw weights.

SUMMARY OF THE INVENTION

The present invention provides a bow which retains all of the features of the take-apart and take-down bows of the prior art, and additionally incorporates the ability to fold the limbs back across the handle for compact storage without detaching the limbs therefrom. Besides retaining the capability of interchanging limbs for incremental draw weight and/or tiller adjustment, the present invention provides additional means for adjusting these characteristics continuously through a substantial range without replacing either limb. This adjustment is accomplished through special ("infinitely variable") adjustment means associated with a central handle. The handle is generally conventional in design and may incorporate all of the customary features of the prior art, but it is adapted at its opposite ends with special connectors which constitute means for attaching the respective limbs to the handle. The connectors include a coupling arrangement which permits the biasing of the limbs with respect to the handle to either increase or decrease their individual defection characteristics.

In general, the improved archery bow of this invention includes a pair of more or less conventional limbs connected at their proximal ends by a handle and at their distal ends by a string as in any other modern bow. Connectors at opposite ends of the handle constitute means for connecting the limbs, and each comprise a frame member hinged near an end of the handle to swing between a first (or strung) position and a second (or folded) position. Each such frame member includes clamping means to anchor a limb at is proximal end to the frame. When the bow is strung, the string constantly pulls the hinged frames towards their strung positions. Tension-adjusting means are carried at each end of the handle in position to operate on a respective frame member when it is in a strung position. The tension-adjusting means constitutes means for selectively determining the attitude of the frame member with respect to the handle in strung position, thereby to selectively increase or decrease the draw weight associated with the limb clamped to that frame member. The tension-adjusting means may also be viewed as determining the attitude of a limb in strung condition with respect to the bow handle.

BRIEF DESCRIPTION OF THE DRAWINGS

In the drawings, which illustrate what is presently regarded as the best mode for carrying out the invention.

DETAILED DESCRIPTION OF THE ILLUSTRATED EMBODIMENT

Figure 1:
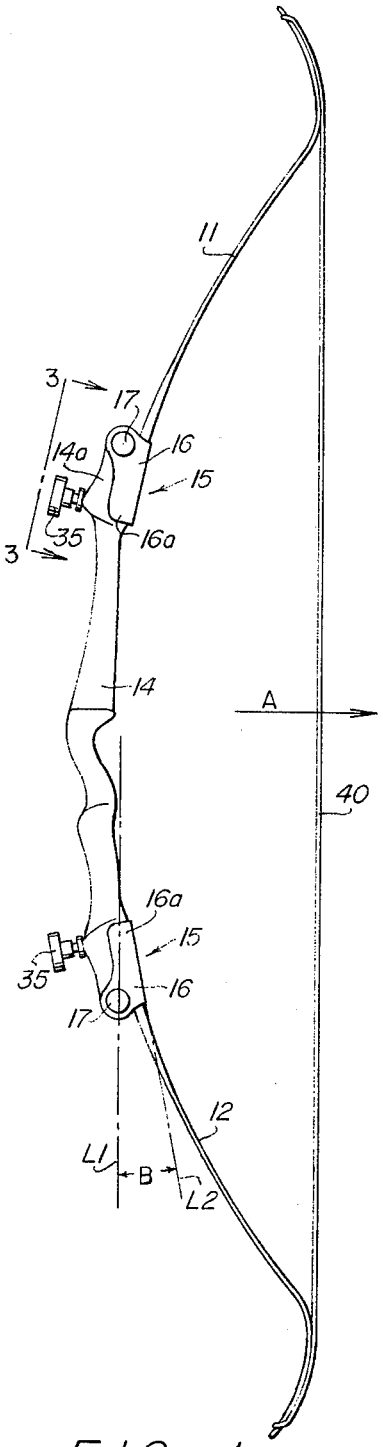
FIG. 1 illustrates the folding archery bow of this jnvention in its strung condition.
Figure 2:
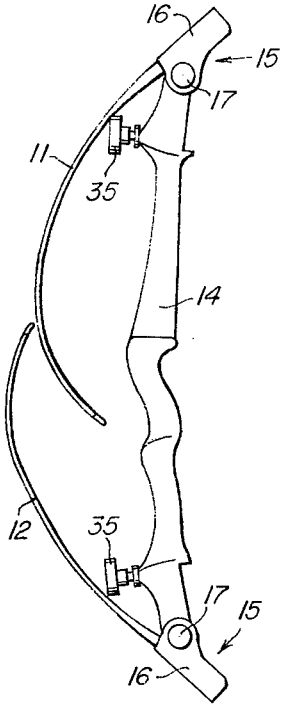
FIG. 2 illustrates the bow of FIG. 1 in its folded condition with the string detached.
Figure 3:
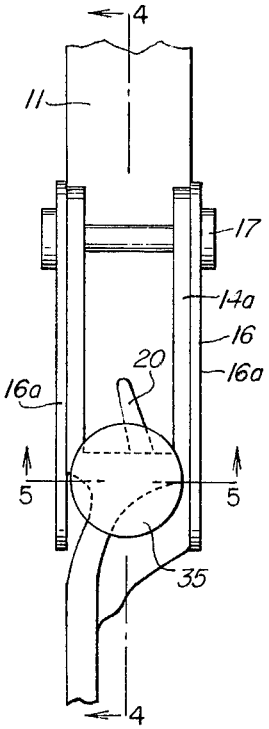
FIG. 3 shows a portion of the bow, including the portion of the handle and connecting structure of the bow indicated by the line 3—3 of FIG. 1, viewed in the direction indicated by the arrows.
Figure 4:
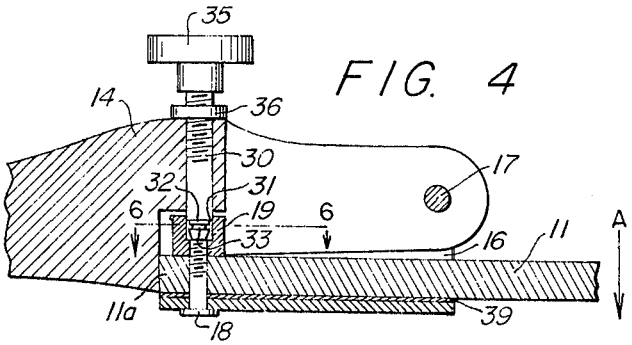
FIG. 4 is a fragmentary view, partially in section, of the limb attachment structure of FIG. 3 taken along the section line 4—4, viewed in the direction of the arrows.

Referring to the drawings, and especially FIGS. 1 and 2, the bow of this invention comprises a pair of limbs 11 and 12 connected to opposite ends of a central handle structure 14 by means of connectors designated generally 15. The connectors include, individually, a frame element 16 connected to a handle end 14*a* by means of a hinge pin 17. FIG. 1 illustrates the bow in fully strung condition with the connector frame 16 pivoted around the pin 17 to its strung position. As best shown by FIG. 3, the opposite sides 16*a* of the frame 16 stradle the end 14*a* of the handle 14. When the frame 16 is in its strung position, the limb 11 is anchored so that its proximal end 11*a* (FIG. 4) bears upon the handle 14 as the string is drawn in the direction indicated by the arrow A. FIG. 2 shows the frame member 16 pivoted around pin 17 to orient the limbs 11 and 12 in their folded condition.

Figure 5:
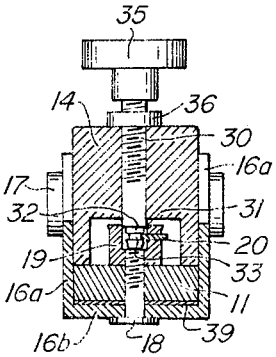
FIG. 5 is a fragmentary view in cross section of the structure illustrated by FIG. 3 taken along the section line 5—5, viewed in the direction of the arrows to show the structure rotated 90° from the view of FIG. 4.

As best shown by FIGS. 3 and 5, the frame element 16 of each connector 15 includes two spaced sidewalls 16*a* adapted to straddle the handle 14*a* and limb 11. These sides 16*a* are integral with, and upstanding from, a base plate 16*b* of the frame 16. The limb 11 is secured to the base plate 16*b* by means of a bolt 18 and nut 19. The limb 11 may be either bored or slotted at its end 11*a* to accommodate the bolt 18, depending on whether it is desired for the limb 11 to be removable from the frame 16 by merely loosening the nub 19 without actually removing the bolt 18. The under surface of the nut 19 constitutes a bearing surface which is drawn towards the inner surface of the base plate 16*b* by the slot 18 so that the nut 19 and base plate 16*a* together constitutes clamping means carried by the hinged frame 16. As shown, a resilient pad 39, which may be, e.g., polyethylene, is placed on the interface between the base plate 16*b* and the limb 11 to inhibit wear and to act as a shock absorber.

Figure 6:
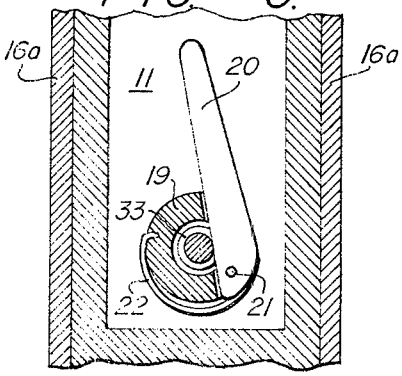
FIG. 6 is a fragmentary view in cross section taken along the section line 6—6 of FIG. 4, viewed in the direction of the arrows.

The nut 19 is of special configuration, and incorporates a latching mechanism for retaining the connector 15 in its strung position with respect to the handle. The latch mechanism is best shown by FIG. 6 and comprises a lever 20 pivotally mounted by a pin 21 to the nut 19 and biased by a spring 22 towards the center of the nut 19. This mechanism is cooperatively adapted to a second bolt 30 which is threaded through the handle 14 to mate with a recess 31 in the face of the nut 19.

With the end 32 of the bolt 30 registered in the socket 31 of the nut 19, the lever 20 registers with a slot 33 in the bolt 30 to retain the frame 16 in strung condition adjacent the handle 14.

In operation, pulling on a bow string 40 (FIG. 1) in the direction A transfers a load or a force through the limbs 11 and 12 to the frames 16, so that the frames tend to rotate about their respective hinge pins 17 in a direction toward the archer. The resulting moment is reacted by the hinge pin 17, frame 16 and handle 14. The bow need only be unstrung to eliminate the deflection force applied to the limbs thereby permitting them to rotate back toward the handle 14 as illustrated by FIG. 2.

The draw weight of each limb 11, 12, may be adjusted by turning the handle 35 clockwise to urge the bolt 30 into the recess 31 to cause the frame 16 to pivot towards its collapsed (folded) position around the pin 17. Movement in this direction increases the "pull" required to deflect the limb anchored by the frame. Turning the handle 35 counterclockwise has the opposite effect. When proper draw weight or tiller is achieved, the position of the frame 16 may be locked by means of the nut 36. Although limbs 11, 12 varying in stiffness or geometry may be interchanged within the connector elements 15, the draw weight available through the use of a limb of given stiffness may be modified within a range of several pounds force through the rotation of the handle 35 as hereinbefore described.

Tillering has conventionally been provided by modifying slightly the dimensions or geometry of the limbs 11, 12. As a result, the archer "feels" uniform distribution of loading even though there is in fact a load differential between the upper and lower limbs of the bow. According to this invention, tillering need not be a function of bow limb geometry; both limbs can be identical and interchangeable. Differences in the attitude or angle B at which a limb extends from the handle 14 permit the limbs 11, 12 to be tillered in precisely the same fashion that draw weight is modified in accordance with the invention. Accordingly, an archer may tiller the limbs to meet his particular requirements in varying situations, and different archers using the same bow may customize the tillering of the bow to their own individual needs. The angle B referred to herein is the angle between a first reference line L1 connecting the hinge pins 17 and a second reference line L2 extending from the outer surface of the plate 16*b* as shown in FIG. 1.

In addition to the folding take-down mode illustrated by FIG. 2, the limbs 11 and 12 may be selectively removed for storage or replacement. When the limbs are bored to receive the bolt 18 as shown, they are removed by loosening the retaining nut 19 and withdrawing the bolt 18. The limbs 11 and 12 may then be pulled out of the frames 16 so that the bow disassembles into four basic units: a handle with the connector elements 15 attached, a pair of bow limbs, and a bow string.

As hereinbefore described, the principal advantage of the present invention is that the bow may be collapsed without tools by merely removing the bow string. In this mode the limbs and handles may be kept together. The bow can be completely disassembled for storage if desired, however. Another notable feature is the complete interchangeability and replaceable character of identical limbs, thereby avoiding the necessity of the prior art for subtle differences in geometry between upper and lower limbs.

Although the invention has been described with particular reference to the illustrated embodiment, it is not intended to thereby limit the scope of the claims which themselves recite those features regarded as essential to the invention. Many alternative mechanisms which function in substantially the same fashion can be readily devised by those skilled in the art who become familiar with the teachings of this disclosure.

I claim:

1. In an archery bow, a bow string, a bow handle, a pair of limbs connected at their proximal ends through respective connectors by said handle and at their distal ends by a said bow string, the improvement wherein each said connector comprises:

a frame means for supporting and pivoting the limbs between a strung position and a collapsed position wherein the limbs are folded across the back of the bow in an unstrung condition, said frame means being hinged near one end of said handle, clamping means associated with said frame means for anchoring one of said limbs at its proximal end to said frame means; and tension-adjusting means carried by said handle in position to operate on said frame means when said frame means is in strung position for selectively varying the attitude of said frame means with respect to the handle, thereby selectively increasing or decreasing the draw weight of said one of said limbs.

2. The improvement of claim 1 wherein said frame member includes opposing side walls which straddle said handle and is hinged to said handle by a pin extending transversely through said handle and said side walls.

3. The improvement of claim 1 wherein said clamping means comprises the inner surface of said frame means adjacent the belly surface of said one of said limbs; a bearing surface adjacent the back surface of said limb and opposing said inner surface of said frame means; and means for drawing said bearing surface towards said inner surface, thereby to clamp the proximal end of said one of said limbs to said frame means.

4. The improvement of claim 3 wherein said bearing surface is the under side of a nut and said means for drawing said bearing surface towards said inner surface comprises a bolt extending through said one of said limbs and said frame means, and engaging said nut.

5. The improvement of claim 4 wherein the proximal end of the limbs is slotted so that said one of said limbs may be pulled out of or inserted into said frame without removing said bolt.

6. The improvement of claim 3 including a resilient pad in the interface between said inner surface of said frame means and said one of said limbs.

7. The improvement of claim 1 wherein said tension-adjusting means comprises means for selectively forcing said frame means to rotate in opposition to the direction of rotation induced by the bow string operating on the limbs in strung condition or to permit said frame means to rotate in the direction of rotation induced by the bow string thereby to change the attitude of said frame means with respect to the bow handle.

8. The improvement of claim 7 wherein said tension-adjusting means includes a shaft threaded through said handle so that one end translates force to said frame when said shaft is rotated to advance through said handle, thereby to pivot said frame in opposition to the direction it is induced to pivot by a draw force on said bow string.

9. The improvement of claim 1 including a first portion of a latching mechanism carried by said handle and a second portion of a latching mechanism carried by said connector, said first and second portions being cooperatively adapted to releasably lock said frame means in strung position.

* * * * *